United States Patent [19]

Lacoste

[11] 4,279,418

[45] Jul. 21, 1981

[54] RACKETS FOR TENNIS AND OTHER GAMES

[75] Inventor: Francois R. Lacoste, Neuilly-sur-Seine, France

[73] Assignee: Patentex S.A., Fribourg, Switzerland

[21] Appl. No.: 48,051

[22] Filed: Jun. 13, 1979

[30] Foreign Application Priority Data

Jun. 15, 1978 [FR] France ..... 78 17893

[51] Int. Cl.[3] ..... A63B 51/00

[52] U.S. Cl. ..... 273/73 D

[58] Field of Search ..... 273/73 R, 73 C, 73 D, 273/73 E, 73 G, 73 H, 73 L

[56] References Cited

U.S. PATENT DOCUMENTS

| | | | |
|---|---|---|---|
| 1,733,960 | 10/1929 | Godfrey | 273/73 D |

FOREIGN PATENT DOCUMENTS

| | | | |
|---|---|---|---|
| 209780 | 6/1960 | Fed. Rep. of Germany | 273/73 D |
| 780531 | 2/1935 | France | 273/73 D |
| 11965 | of 1911 | United Kingdom | 273/73 D |
| 234021 | 5/1925 | United Kingdom | 273/73 E |
| 1238182 | 7/1971 | United Kingdom | 273/73 D |

*Primary Examiner*—Richard J. Apley

*Attorney, Agent, or Firm*—Merriam, Marshall & Bicknell

[57] ABSTRACT

A racket for tennis and other similar games, comprising a sensibly oval or pear-shaped stringing surface and an auxiliary element for maintaining the strings in a median plane at determined places, in which at least some strings are wound simultaneously around the frame and around the said auxiliary element.

6 Claims, 17 Drawing Figures

T1
G
M92
M42
M91
M41
T18
1b
1b
E

RACKETS FOR TENNIS AND OTHER GAMES

BACKGROUND OF THE INVENTION

The present invention concerns a racket for tennis and similar games as badminton, squash, etc. . . .

In classical rackets, the "main" and "cross" strings making the stringing pass through holes pierced in the frame which bears directly the tension of the strings.

The use of stringing by holes has noticeable drawbacks, the foremost being a reduction of the strength of the frame, specially in the region generally called "heart", joining the handle to the strung part of the frame. When this heart includes a brace, it is the holes pierced near the ends of this brace which are generally the cause of breaks. Besides, the strings bear on the edges of the holes and they are cut and broken easily, specially when the frame is made of metal tubing.

These drawbacks have been lessened by placing in the holes of the frame of the racket small plastic tubes protecting the strings from the contact with the edges of the holes. Unfortunately this solution leads to enlarge the holes which increases the possibility of frame breakage, specially, as it has been said above, in the "heart".

PRIOR ART

A solution, entirely different of the problem of attaching strings, has been proposed in U.S. Pat. No. 3,086,777. According to this patent, the strings are attached to the crenellations or teeth of an auxiliary element, itself attached to the frame. This auxiliary element achieves two functions: maintaining of the strings in the median plane of the frame and bearing the tension of the strings.

However, in this patent, this element or "crown" bears all the tension of the strings and it must then be strong and be made with steel wire of great resistance. It weighs about 20 g. This crown must itself be attached to the frame with a steel wire strong enough to resist the tension of the strings. Practically, the weight of the string wire used to attach the said crown on to the frame is more than 25 g.

OBJECTS OF THE INVENTION

The present invention has for object a racket, also including one or several auxiliary elements for the stringing, in which are eliminated or reduced the holes, a source of weakness in the frame, and the weight of the auxiliary elements and of the means used to tie them to the frame.

Another object of the present invention is to increase the resiliency of the stringing, particularly near the frame, specially in the region of the heart, and to obtain an excellent response of the stringing at impact of the ball on a surface noticeably more extended than with a frame of the same size by the means previously used.

According to the present invention, the tennis racket is characterised in the fact that certain at least of the strings surround at the same time the frame and the said auxiliary element which they retain against the inner periphery of the frame.

Thus, the steel wire which was used to tie the auxiliary element to the frame is eliminated at least in part thus reducing noticeably the total weight of the racket.

DESCRIPTION OF THE DRAWINGS

Other characteristics and advantages of the invention will appear in the course of the description which will follow of various modes of embodiment given as non-limiting examples, in view of the accompanying drawings which show.

DESCRIPTION OF PREFERRED EMBODIMENTS

Figure 1:
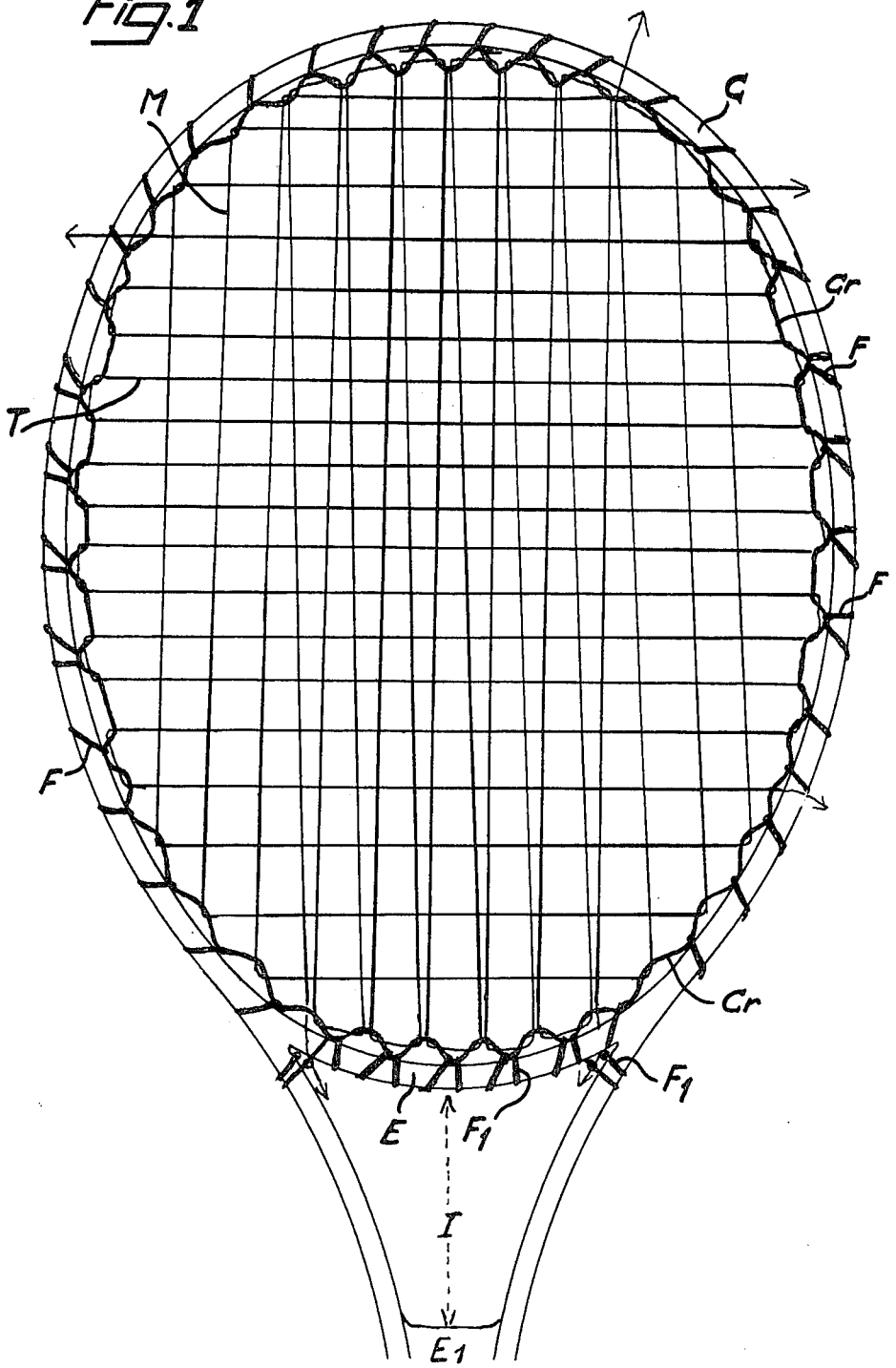
PRIOR ART Fig. 1
FIG. 1, a racket with a metal crown of the prior art.

FIG. 1 shows a racket of a known type and now available on the market. Within the oval of frame C comprising a main brace E and a secondary brace E1 welded or brazed to the frame is placed a crenellated crown Cr, the "main" M and the "cross" T strings being attached on the crown, itself strongly fastened on the frame C by a steel wire F. In FIG. 1, one sees that because of the small distance separating the braces which prevents the passing of the tool usually employed for placing the wire attaching the crown to the frame, the manufacturer has been led to attach the part of the crown Cr in contact with the brace E by a steel wire F1 which is independent of the steel wire F used to fasten the crown on the frame itself, thus complicating the construction of the racket.

Figure 2:
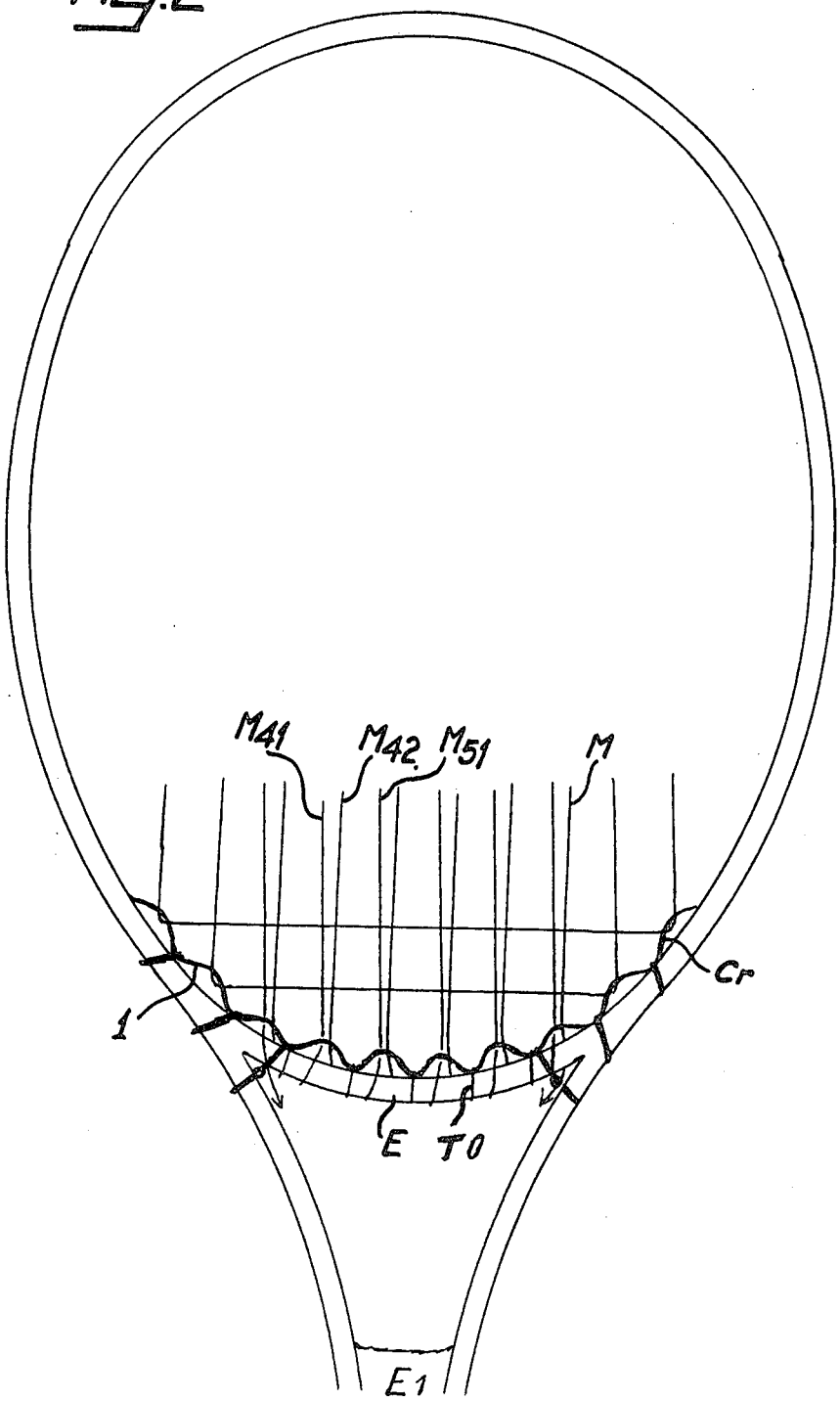
FIG. 2, the "heart" part of a racket strung according to the invention.

Thanks to the invention, wire F1 may be eliminted as shown on the FIG. 2 by attaching directly the "main" M in the center of the racket to the brace E. In FIG. 2 the auxiliary element may be either a complete crown bearing the reference Cr or a part of the crown limited to the region of the heart bearing the reference 1.

Figure 3:
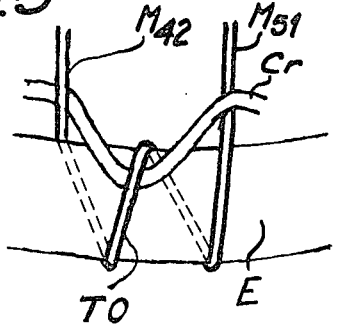
FIG. 3, a view at enlarged scale of the means used to fasten the strings and the auxiliary element on the frame.

FIG. 3 represents the passing of mains M42 and M51 of FIG. 2 through the spaces comprised between the crown Cr and the frame. According to the invention, the turn TO is made around both the brace E and the crown Cr. This crown is, under these conditions, sufficiently maintained against the brace because it does not have to resist the full pull of the main in this region of the "heart", but only to maintain the strings in the plane of the stringing at determined positions.

Figure 6:
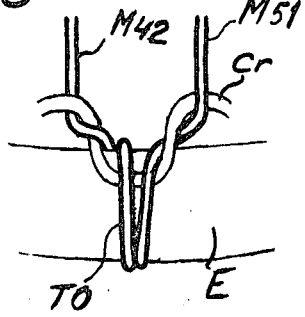
FIG. 6, another means for fastening the strings and maintaining the auxiliary element against the frame of the racket shown in FIG. 2.

FIG. 6 represents another solution differing from the preceding one only by passing "main" M42 and M51 strings spirally around the sides of the teeth of the crown, but without changing the conditions by which the crown Cr is maintained against the brace still by winding the strings around both the brace and said crown.

It is thus possible to achieve one of the objects of the invention locally with a saving of weight corresponding to the difference between the weight of the length of steel wire F1 which is eliminated, and the very small weight of the length of the strings passing around the brace E and the auxiliary element 1. The additional length of the strings advantageously increases the resiliency of the stringing in the region close to the frame near the brace, which is very useful and very clearly felt in play tests, when the ball is struck far from the center, near the brace.

Figure 4:
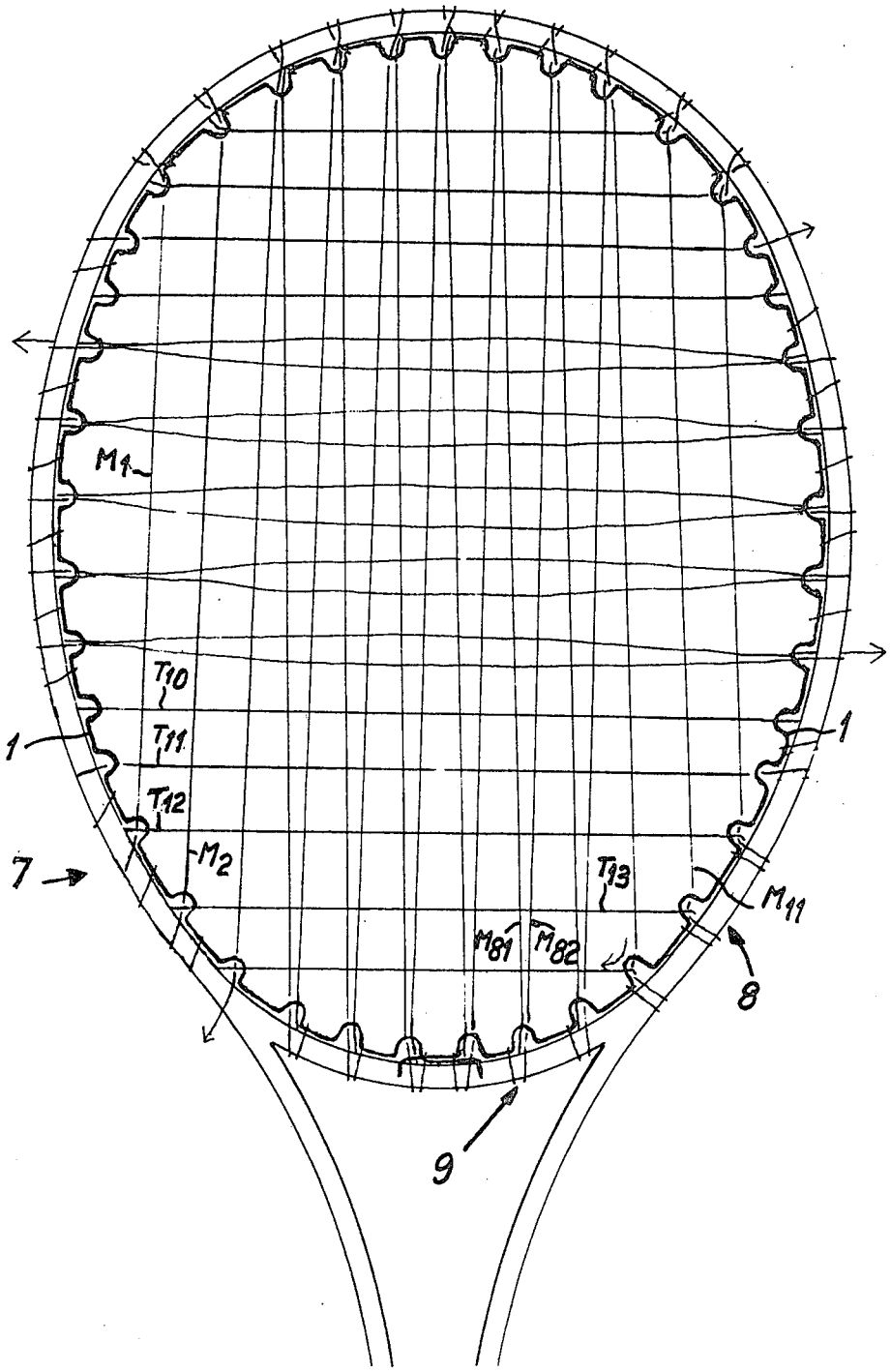
FIG. 4, a racket entirely strung according to the invention.
Figure 5:
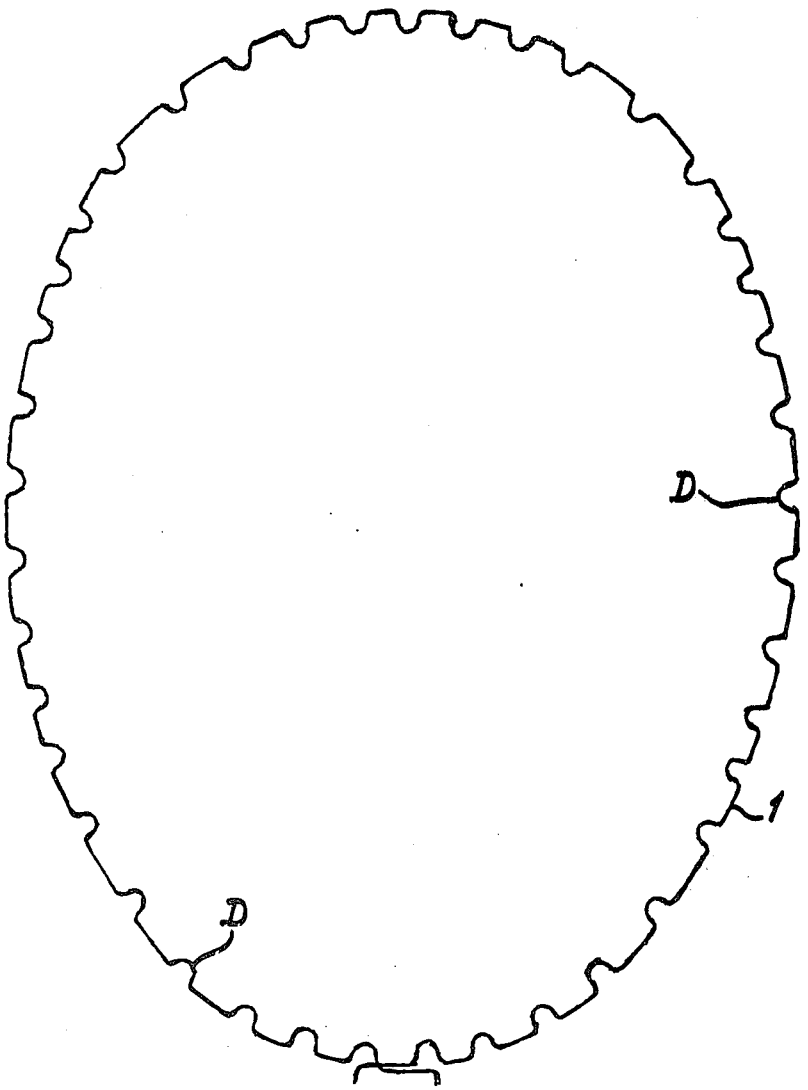
FIG. 5, the auxiliary element used for the stringing of the racket represented in FIG. 4.

The racket which is represented in FIG. 4 is entirely strung accordingly to the present invention, thanks to an auxiliary element 1 forming an annular crown represented in FIG. 5. This crown is simple and easier to make than crowns such as the one which is indicated by the reference Cr in FIG. 1.

In FIG. 5, crown 1 comprises U-shaped teeth D similar to each other, opening towards the frame and interconnected by substantially straight lengths of wire which abut the inside of the oval part of the frame of a racket in which the crown is installed. In the FIG. 4, the steel wire corresponding to F in FIG. 1 used to attach the crenellated crown to the frame has been entirely eliminated which results in a reduction in weight. Since the crown is not required to bear the full tension of the strings, which are fastened to the frame, an additional saving in weight can be made by forming the crown of a lightweight alloy of titanium or aluminium, while the increased lengths of the strings necessary for passing around the frame and the crown only represent a minimum weight.

Thus the saving of weight becomes very noticeable and exceeds half of the 45 g. necessary for the crown and the attaching wire of a racket such as the one which is represented in FIG. 1.

It then becomes possible to make frames stronger and stiffer, for example by increasing slightly the thickness of the wall of the tube of which they are made or to make more easily lighter frames or frames with larger stringing surfaces. In play, the racket of the invention achieves results which would only be possible with a larger stringing surface, thanks to the increased resiliency produced by the passing of all the strings around the frame which increases their useful length.

Another important advantage of the invention is that the angles of the curves of the strings around the frame and at the contact points with the annular element are greater than in the case of previously known rackets. It then becomes possible to increase the tension of the strings and/or to use very thin natural gut with very reduced risks of breaks at attaching points.

Figure 8:
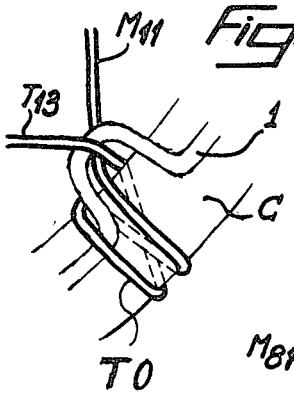
FIGS. 7, 8, 9, enlarged details showing the mode of fastening the stringing on the frame at points 7, 8 and 9 of FIG. 4.
Figure 7:
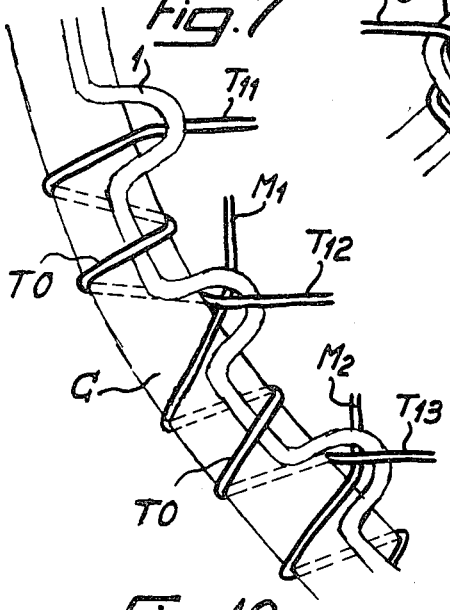
Figure 9:
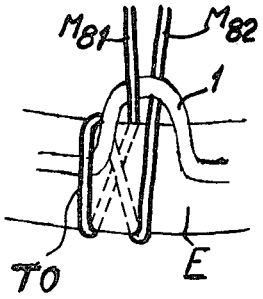
Figure 10:
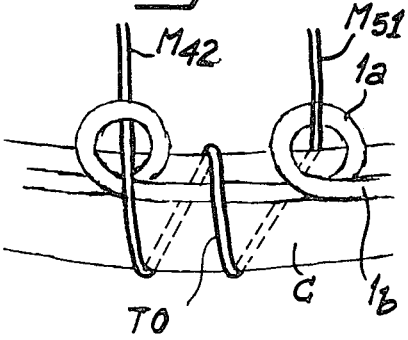
FIGS. 10, 11 and 12, similar drawings showing another mode of fastening the stringing according to the invention.
Figure 11:
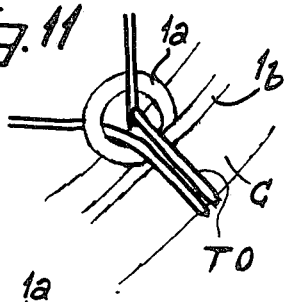
Figure 12:
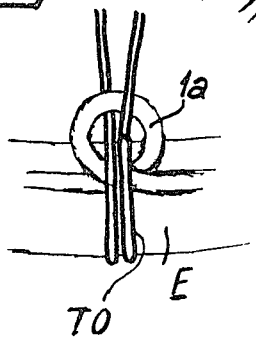

The FIGS. 7, 8 and 9 represent at enlarged scale several methods of wrapping the strings around the crown and the frame in the region of points 7, 8 and 9 of the FIG. 4. In FIG. 9, one sees for example that the main M81 passes on one side of the crown 1 and through the space defined by the crown 1 and the brace E before passing behind the brace and around it and the crown 1 as TO, on the left of the teeth, then returns in front of the brace before returning through the teeth in passing on the other side of the crown 1 to constitute the second string of the double main 82. Details at enlarged scale of another type of crown or auxiliary element are represented in FIGS. 10, 11 and 12, this crown differing from the one shown in the FIG. 5 in the fact that the U-shaped teeth are replaced by loops or small circles 1*a*, the strings passing through holes created by these loops and, according to the invention, around the crown 1*b* and the frame C or its brace E to maintain the said crown against the said frame or the said brace.

Figure 13:
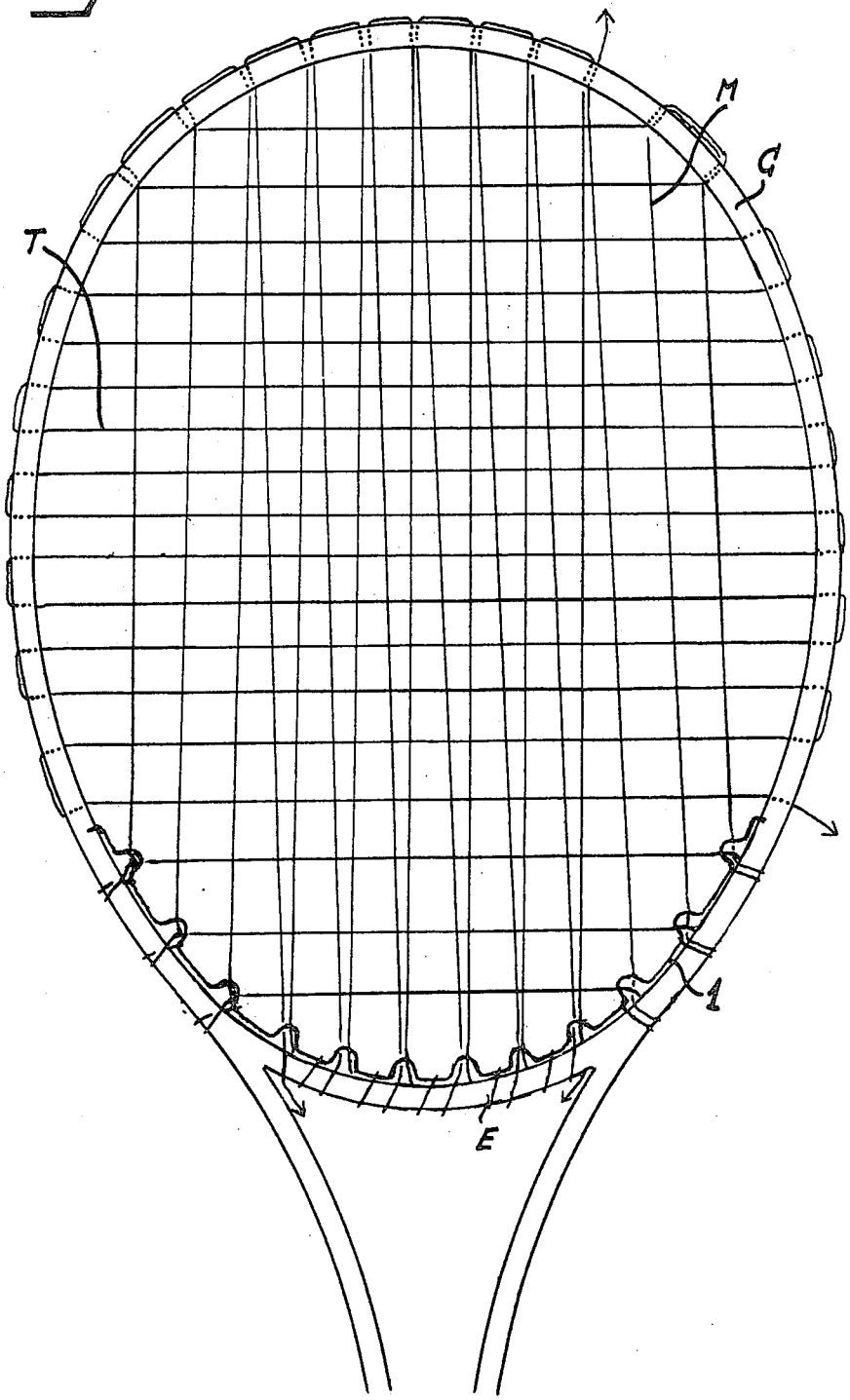
FIG. 13, a racket partly strung through holes and comprising an auxiliary element in the region of the heart.

The racket shown in FIG. 13 is partly strung through holes. However in all the region of the heart, including the brace, there are no holes in the frame for the stringing and the stringing is achieved by means of an auxiliary element 1 comprising teeth of the type previously described and shown in FIG. 5.

In the embodiment of FIG. 13, some of the advantages supplied by the invention are even more important than those mentioned about the embodiment shown in the FIG. 4; the saving of weight is greater and the opportunity to increase the durability or stiffness of the frame or to make easily lighter rackets or rackets with large stringing surfaces is increased.

Figure 14:
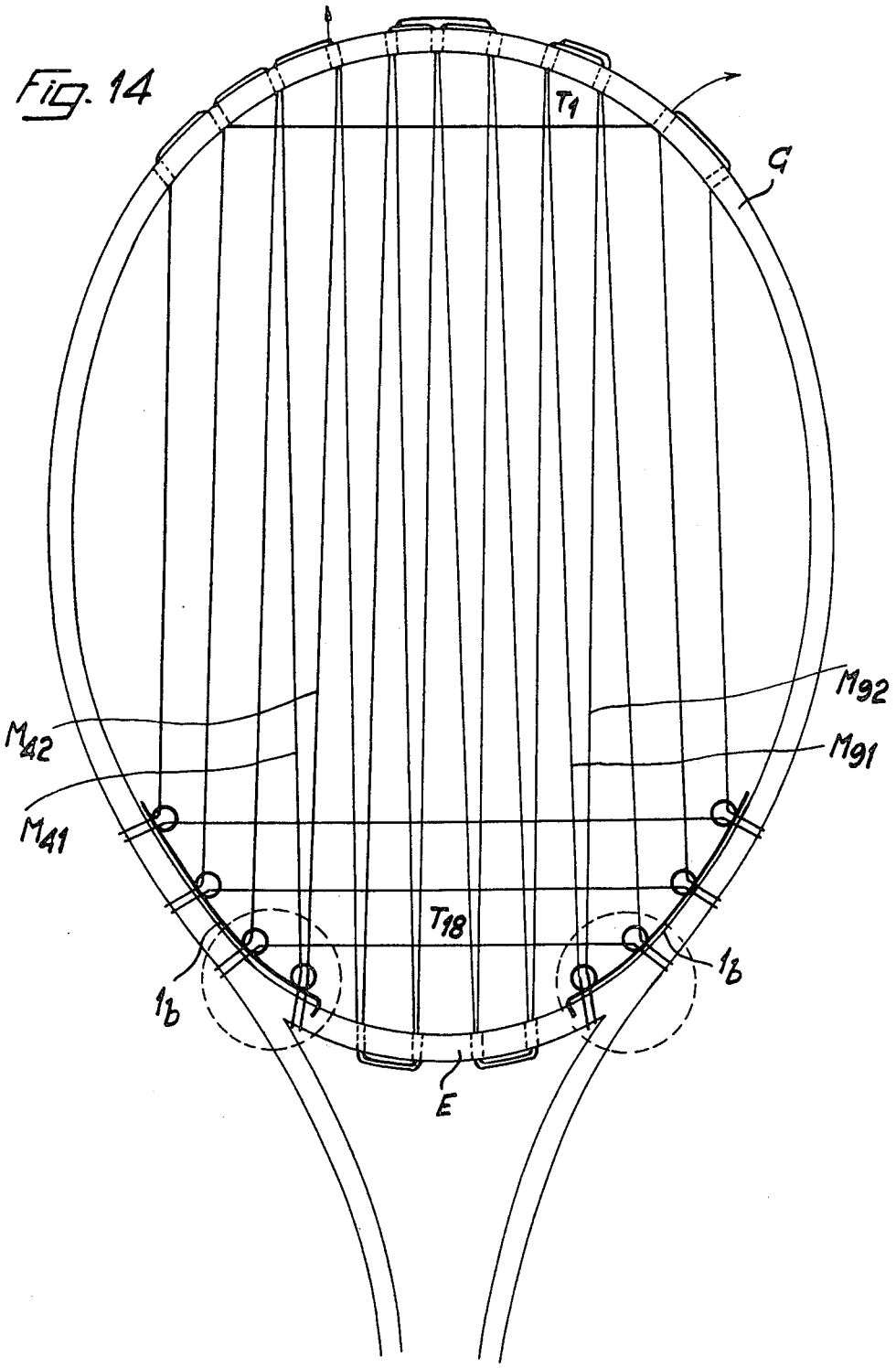
FIG. 14, a racket also partly strung through holes and comprising two auxiliary elements in the region of the heart.

FIG. 14 shows, without its "cross" strings, which are identical to those of FIG. 13, a racket mostly strung through holes pierced in the frame, but also with the help of two small auxiliary elements 1*b* in the regions close to the ends of the brace E.

These auxiliary elements 1*b* comprise holes created in the center of loops such as those shown in FIGS. 11 and 12 which require a length of metal wire slightly greater than the teeth of element 1 of FIG. 13 but because of their small length these elements have however a reduced total weight ((for example less than 6 g. in steel and less than 4 g. in titanium alloy)).

Figure 15:
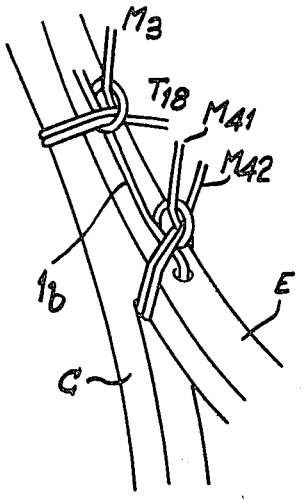
FIGS. 15 and 16, parts of FIG. 14 enlarged and from different angles.
Figure 16:
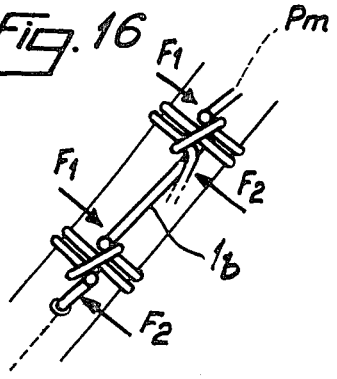

As seen in FIGS. 15 and 16, representing at enlarged scale the circled regions of the FIG. 14, these loops offer several advantages. The loops are not exactly formed in the median plane of the stringing, but are characterised by a small inclination in relation to this median plane, tending to place the strings going through the loops slightly better in the said plane and also increasing advantageously the length of their contact with the loops.

In other variations of the invention, it is possible to attach all the "main" strings, including those attached by holes in FIG. 14, with the help on a single auxiliary element replacing the one represented in FIG. 14, but comprising only loops as those of the element 1*b* of the FIG. 14, or even with the help of an element comprising teeth as those of FIG. 13 in the middle and loops as those of the FIG. 14 at its ends.

With these embodiments, one obtains an important saving in weight in comparison with a racket of the type represented in FIG. 1 and there is not any hole liable to weaken the frame "under" the brace, i.e., between this brace and the handle, not just "above" the brace, i.e. in the regions where breaks by strain most often occur.

Besides, these embodiments increase noticeably the resiliency in the region of the stringing near the heart where this increase is precisely the most advantageous.

The increase in resiliency occurs in all cases, as indicated above, because of the increase of the length of the strings passing around the frame or the brace, but also, in the case of loops like those of the FIGS. 14, 15 and 16, made of resilient metal wire, because of the torsion effect exerted upon the loops following the arrows F1 and F2 of the FIG. 16 and of the resilient resistance of the loops to this torsion effect.

The embodiments of the invention which have just been described or represented are only given as examples. With crowns analogous to the one shown in FIG. 5, it is possible to attach "cross" strings in the manner of the "main" strings of FIG. 4 with a passing around the crown and the frame as indicated on FIG. 9, or to attach the central main strings according to the method represented for the "cross" strings of the FIG. 4.

However the mode of attaching used for instance for the "main" strings of the FIG. 4 is specially interesting as it permits counterbalancing immediately, during the stringing, the pressures exerted perpendicularly to the stringing upon the auxiliary elements and adapts itself very well to a possible protection of these "main" at the end of the frame opposed to the handle, for instance by a spiral winding around the frame of a light but abrasion resistant strip, covering the parts of the strings passing on the outside of the end of the frame.

The stringing modes described can be easily achieved after some training with the help of most of the existing stringing machines, the easy gliding of the strings around the different types of auxiliary elements and around the frame or the brace permitting the creation of specially high tensions without risk of breakages.

It is interesting to note on all of FIGS. 3, 6, 7, 8, 9, 10, 11, 12 that two strings passing around the sides of the same teeth or through the space formed between a tooth and the frame or by a loop or through two adjacent teeth or loops, bear on opposite sides of the auxiliary element in order to balance the pressures exerted by the said strings upon the said auxiliary element, which permits limiting the weight and the stiffness of the said element.

In the embodiments represented by the FIGS. 2, 13 and 14, each tooth or loop is crossed by two strings passing respectively through the said tooth or loop, in opposite directions with two pressures exerted upon the opposite sides of the auxiliary element which balance themselves.

Concerning the FIG. 4, some teeth are crossed only by a single string, but in this case the two nearest teeth are each crossed by strings, one at least for each one of these adjacent teeth, passing upon the side of the auxiliary element opposite to the side upon which passes the single string, which compensates, at least partly, the pressure exerted upon only a side of the crown by the single string.

The auxiliary elements described and represented in the previous embodiments of the invention are made of metal wire with a diameter for instance less than 2 mm.

But it is possible to use elements made of plastic material, for instance ABS or high resistance polyamides.

Figure 17:
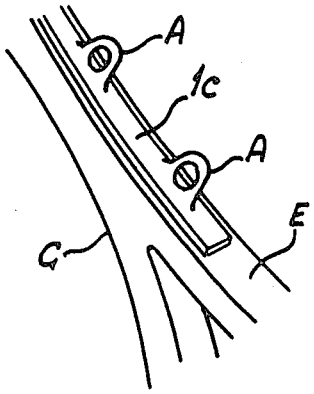
FIG. 17, same part of FIG. 14 as the FIG. 15 with another auxiliary element.

The FIG. 17 represents, from the same angle as the FIG. 15, part of an element 1*c* which may replace the elements 1*b*. The holes of this molded element replace those created in the center of the loops of the element 1*b*. Practically, the element 1*c* is made of a group of rings A with a section slightly above 2 mm and of a thin strip applying to the inside of the oval of the frame replacing the straight parts of the elements 1*b* and tying these rings together.

As the loops of the elements 1*b*, these rings are advantageously inclined in relation to the median plane of the stringing.

A non negligible result may be obtained according to the invention with elements made only with a simple ring, as shown on FIG. 15 preferably in plastic material, permitting for instance the attachment without holes in the frame of the "main" M41 and M42 and M91 and M92 for which the position of these holes presents the most drawbacks with a racket comprising a brace.

It is evident that changes may be brought to the modes of embodiments which have been described, notably by substitution of equivalent technical means limiting the scope of the present invention for this reason.

What I claim is:

1. A racket for tennis and similar games comprising:
- a handle;
- a generally oval frame attached to said handle,
- an arcuate auxiliary element conforming to and in contact throughout its length with the inner periphery of said frame,
- a plurality of strings extending across said frame and forming a striking face,
- said auxiliary element being provided with means for engaging at least some of said strings and maintaining said strings in the median plane of said frame,
- at least some of said strings being wound about both said frame and said element as the principal means of maintaining said element in contact with said frame.

2. A racket according to claim 1 wherein said auxiliary element spans the point of attachment of said frame to said handle.

3. A racket according to claim 1, wherein said auxiliary element is formed of metal wire.

4. A racket according to claim 1 wherein said auxiliary section comprises a plurality of crenations extending inwardly from said frame and engaging said strings.

5. A racket according to claim 1 wherein said auxiliary element comprises a plurality of U-shaped teeth open toward said frame, adjacent teeth being joined by arcuate sections in contact with said frame, each of said teeth engaging a string which passes through an opening defined by said tooth and said frame, said string encircling both said frame and an adjacent one of said sections and passing through said opening or a corresponding opening defined by an adjacent tooth.

6. A racket according to claim 1, wherein said auxiliary element comprises at least one loop through which at least one of said strings passes, said one string being wrapped around said frame and said element.

* * * * *